US007690524B2

(12) United States Patent
Chau

(10) Patent No.: US 7,690,524 B2
(45) Date of Patent: Apr. 6, 2010

(54) BOTTLE WITH MULTI-FOLD PROTECTIVE COVER AND LEAK-PROOF CLOSURE DEVICE

(76) Inventor: Yiu Chau Chau, 80 W. Beaver Creek Road, Unit 14, Richmond Hill, Ontario (CA) L4B 1H3

( * ) Notice: Subject to any disclaimer, the term of this patent is extended or adjusted under 35 U.S.C. 154(b) by 1328 days.

(21) Appl. No.: 11/127,543

(22) Filed: May 11, 2005

(65) Prior Publication Data

US 2006/0255036 A1 Nov. 16, 2006

(51) Int. Cl.
*B65D 51/18* (2006.01)
*B65D 83/00* (2006.01)
*A47G 19/22* (2006.01)

(52) U.S. Cl. ..... 220/254.3; 220/252; 220/714; 220/707; 215/387

(58) Field of Classification Search ..... 220/252, 220/707, 717, 714, 254.3, 833, 826; 222/525; 215/387
See application file for complete search history.

(56) References Cited

U.S. PATENT DOCUMENTS

| | | | | |
|---|---|---|---|---|
| 3,738,545 | A * | 6/1973 | Roy | 222/525 |
| 5,203,468 | A * | 4/1993 | Hsu | 220/254.3 |
| 5,259,538 | A * | 11/1993 | Tardif | 222/528 |
| 5,337,931 | A * | 8/1994 | Kitterman | 222/525 |
| 6,050,433 | A * | 4/2000 | Russell et al. | 215/229 |
| 6,257,463 | B1 * | 7/2001 | De Polo | 222/525 |
| 6,523,711 | B1 * | 2/2003 | Hughes et al. | 220/709 |

* cited by examiner

*Primary Examiner*—Robin Hylton
(74) *Attorney, Agent, or Firm*—Craig A. Fieschko, Esq.; DeWitt Ross & Stevens S.C.

(57) ABSTRACT

A bottle includes a container and a closure device. The closure device includes a threaded cap for closing up the container, a slidable spout for opening and closing the fluid flow path from the container by means of two sealing elements on the spout, a vent check valve for permitting air to rapidly enter the container without passing through the spout and a multi-fold protective cover and, more particularly, to a two-fold protective cover for achieving the leak-proof by forcing the spout to a close position and closing up the vent check valve by a projection extended from the protective cover.

32 Claims, 8 Drawing Sheets

BOTTLE WITH MULTI-FOLD PROTECTIVE COVER AND LEAK-PROOF CLOSURE DEVICE

FIELD OF THE INVENTION

The present invention generally relates to the field of bottle for containing fluid for outdoor use and including an easily open and close multi-fold protective cover and, more particularly, to a two-fold protective cover and a leak-proof push-pull closure device with vent check valve.

BACKGROUND OF THE INVENTION

Conventional bottles for outdoor use are usually equipped with protective cover and the protective cover is a one-piece design with dimension same as the threaded cap. The one-piece protective cover design of the prior art is difficult to open and close by one hand. Some examples of this general type of protective cover are found in U.S. Pat. Nos. 5,603,436 and 5,094,363.

Another fast push-pull spouts design is also common feature of the bottles. Some examples of this general type of push-pull spouts design are found in U.S. Pat. Nos. 3,738,545; 5,100,033; and 5,094,363. Many of these past designs are difficult to operate and/or do not provide adequate leak protection.

Another vent check valve design permits air to rapidly enter the bottle without the need to pass through the water treatment unit to equalize the pressure in the bottle as water is treated and removed is also a common feature of the bottles. However, leakage through the vent check valve happens frequently.

It is therefore advantageous to design a bottle devoid of the shortcomings associated with the prior art bottles.

SUMMARY OF THE INVENTION

The present invention provides a multi-fold protective cover and, more particularly, provides a two-fold protective cover with dimension smaller than the threaded cap can be easily opened and closed by one hand. For example, a bicyclist often requires the use of the bottle by one hand.

The present invention of push-pull spout design provides both ease of operation and adequate leak-proof protection.

The present invention of vent check valve design enables the vent check valve to be securely closed at all time by a projection extending from the upper protective cover when the multi-fold protective cover and, more particularly, to a two-fold protective cover is in a close position.

One principal aspect of the present invention provides for a multi-fold protective cover and, more particularly, to a two-fold protective cover with dimension smaller than the threaded cap to enable easy opening and closing by one hand.

Another principal aspect of the present invention provides for an upper protective cover of the multi-fold protective cover and, more particularly, to a two-fold protective cover to ensure the slidable spout is always kept in the close position for achieving the leak-proof of fluid from accidentally opening of the spout.

Still another principal aspect of the invention provides for a vent check valve which is always closed up by a projection extending from the upper protective cover when the multi-fold protective cover and, more particularly, to a two-fold protective cover is in a close position for achieving the leak-proof of fluid from accidentally opening of the vent check valve.

Still yet another principal aspect of the invention provides for a spout which includes two sealing elements for opening up and closing off the fluid path from the container.

According to one aspect of the present invention, it provides a bottle which comprises (a) a container; and (b) a closure device. The closure device comprises (i) a threaded cap for closing the container; (ii) a hollow central tubular element defining a flow path through the cap, the central tubular element including three sections, the inside of the upper section with a transverse dimension larger than that of the middle section, the inside of the bottom portion of the upper section is chambered to a transverse dimension same as that of the middle section and the inside of the lower section with a transverse dimension larger than that of the middle section; and (iii) a spout having an outlet opening and is inserted in the central tubular element for sliding along an axis between open and close positions, the spout is hollow including the upper section and lower section with a partition in between the upper section and the lower section, the spout also including two sealing elements, the first sealing element is disposed about an outer surface of the upper section and the second sealing element disposed about an outer surface of the lower section, the top chamber portion of the upper section with a transverse dimension bigger than that of the lower portion of the upper section, the bottom of the upper section with openings on the space in between the inner surface of the outer section and outer surface of the lower section, the wall of the lower section also with openings below the second sealing element and the bottom of the lower section with an annular flange.

According to another aspect of the present invention, it provides an inventive multi-fold cover, in which each fold is a curved sector with two hinged holes at the two sides of the vertex end of the each fold, the first fold is with the curved plate at the outer top surface, the last fold is with a plate at the back, a projection is on the inner surface of the back plate of the last fold, and at least one recess is above the front arc of the first fold at the inner surface of the first fold.

BRIEF DESCRIPTION OF THE DRAWINGS

Advantages and features of the invention will become more apparent with reference to the following description of the presently preferred embodiment thereof in connection with the accompanying drawings, wherein like references have been applied to like elements, in which.

DETAILED DESCRIPTION OF THE PREFERRED EMBODIMENTS

Figure 1:
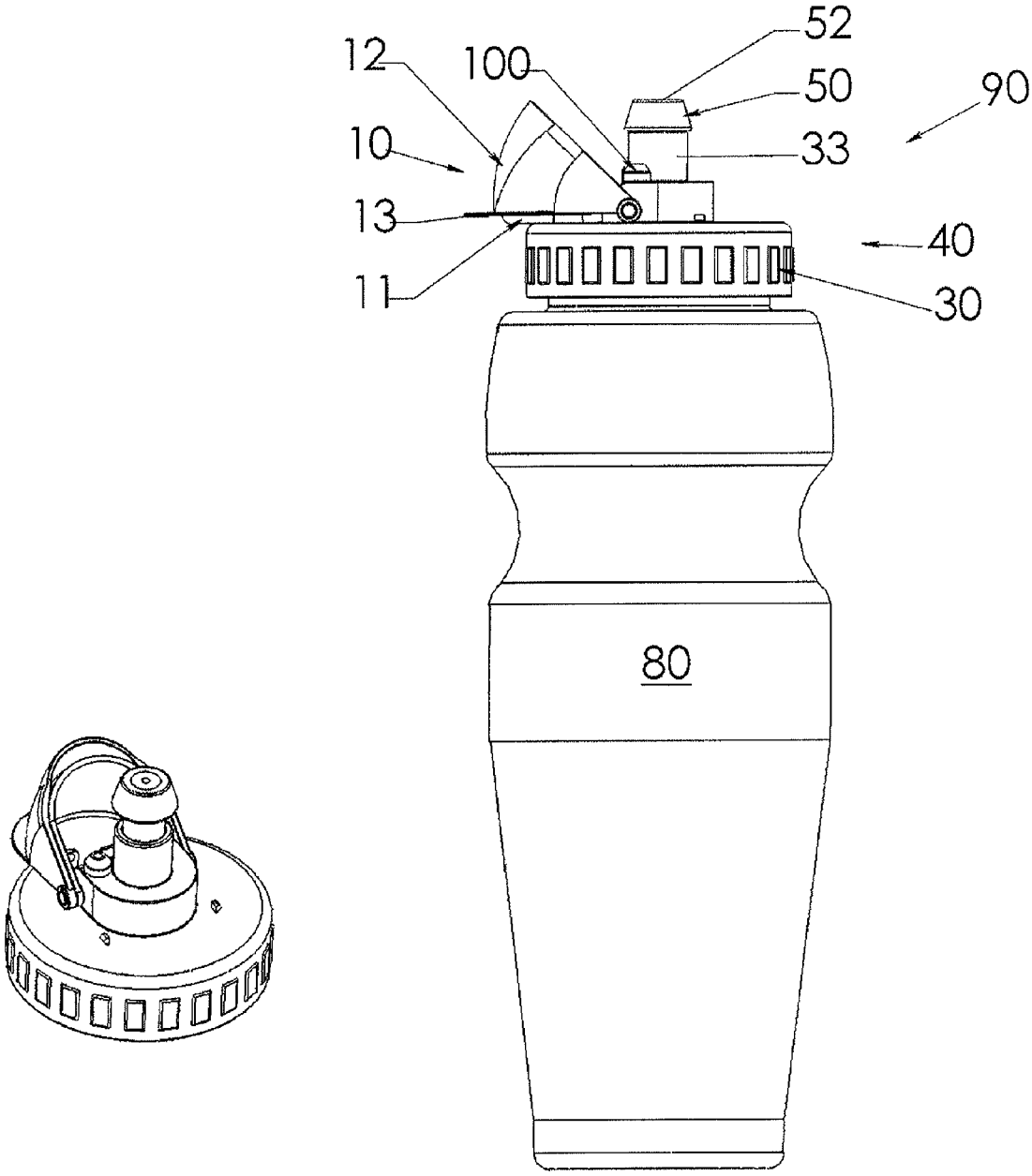
FIG. 1 is an elevation view of a bottle constructed in accordance with the present invention.

Referring to FIG. 1, a bottle 90 includes a closure device 40 for closing a container 80 used for containing liquids. Closure device 40 comprises a threaded cap 30, a spout 50, a vent check valve 100 and a two-fold protective cover 10. A spout 50 is inserted in the upper section of a hollow central tubular element 33 of the threaded cap 30 with a push-pull connection which allows spout 50 to be moved up with respect to threaded cap 30 to an open position, and down to a close position as described in further detail below. Preferably, the thread cap 30 has a raised platform at the center for closing the container 80. More preferably, thread cap 30 includes two pivot pins 31*a* and 31*b* located systematical above the surface of threaded cap 30 behind the center of the threaded cap 30. In addition, at least one snap lock, such as left and/or right snap lock 36*a* and/or 36*b* is located on the surface of the threaded cap 30 in front of the center of the threaded cap 30, together with a hole 38 in the central platform for putting in the vent check valve 100 (see description below).

Spout 50 includes an upper outlet opening 52 for discharging fluids out of the container 80. The two-fold protective cover 10 comprises an upper protective cover 11 and a lower protective cover 12. A tongue-shaped handle 13 is provided on the lower protective cover 12 for enabling a user to use a finger to open and close the two-fold protective cover 10 described below.

The present invention discloses a multi-fold protective cover and, more particularly, to a two-fold protective cover, each fold is a curved sector with two hinged holes at the two sides of the vertex end of each fold, the first fold is with the curved plate at the outer top surface, the last fold is with a plate at the back. A projection extends from the inner surface of the back plate of the last fold, and there is at least one recess located above the front arc of the first fold at the inner surface of the first fold.

Figure 2:
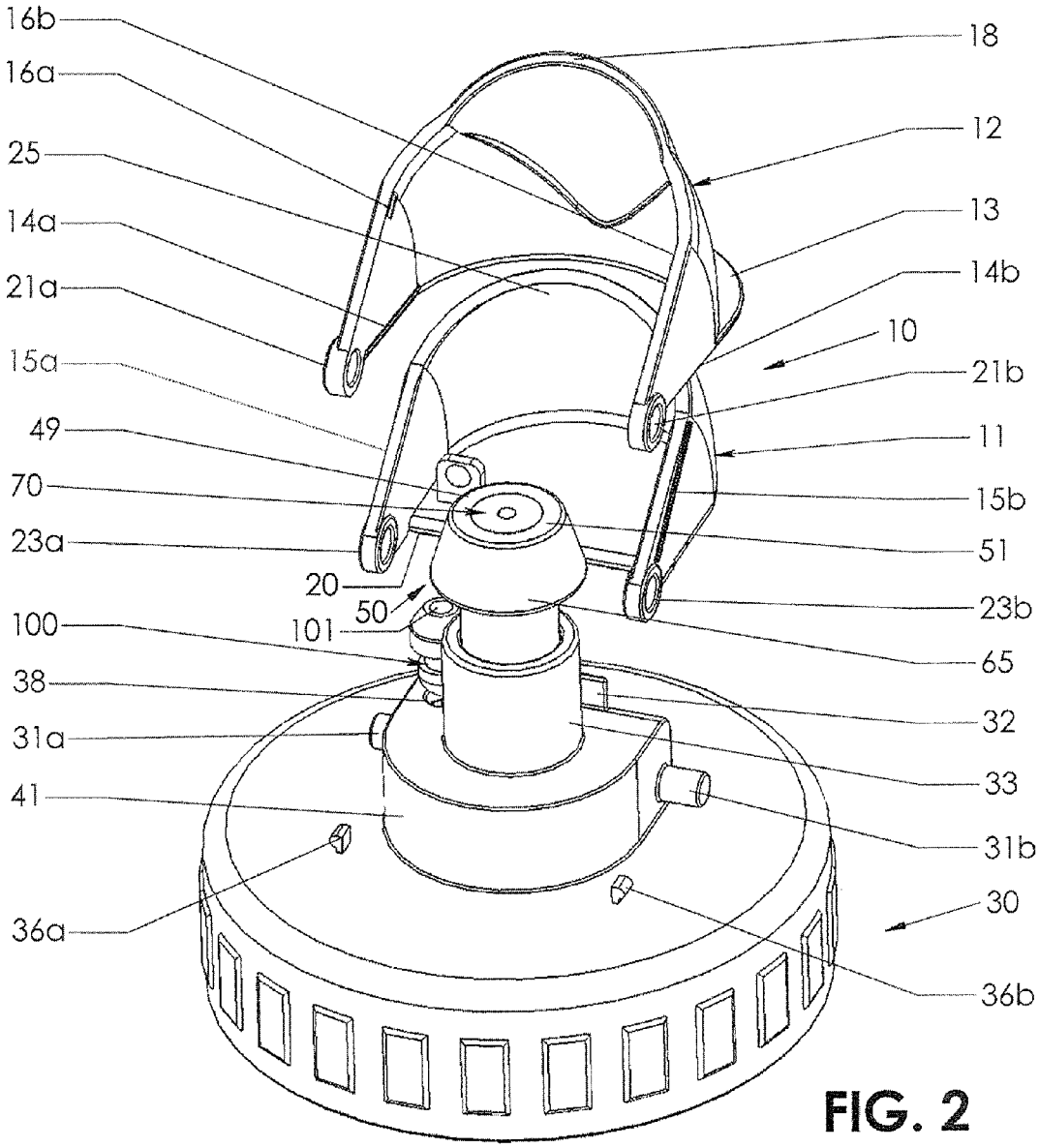
FIG. 2 is an exploded view of a preferred embodiment of closure device, including a threaded cap, a vent check valve, a spout and a two-fold protective cover, of FIG. 1.
Figure 3:
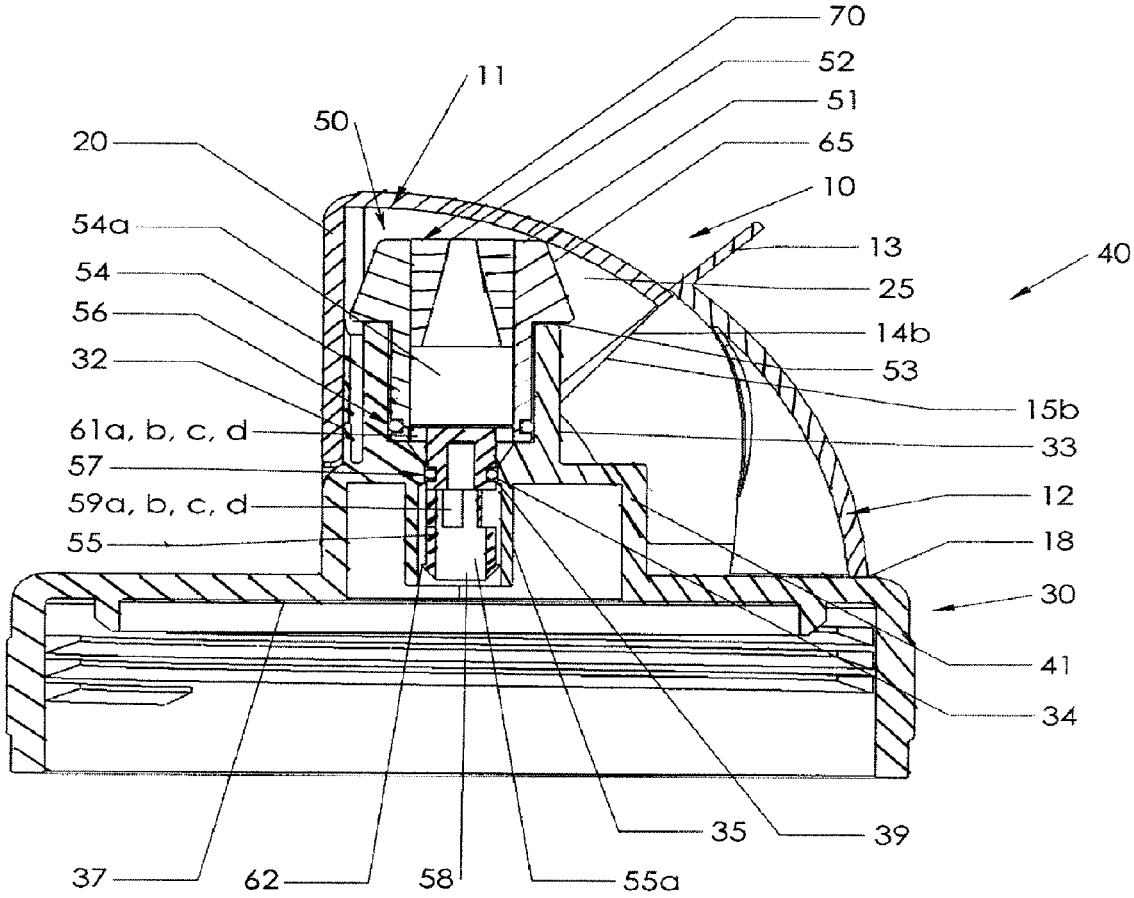
FIG. 3 is a cross sectional view of FIG. 2 showing both the two-fold protective cover and the spout are in a close position.
Figure 4:
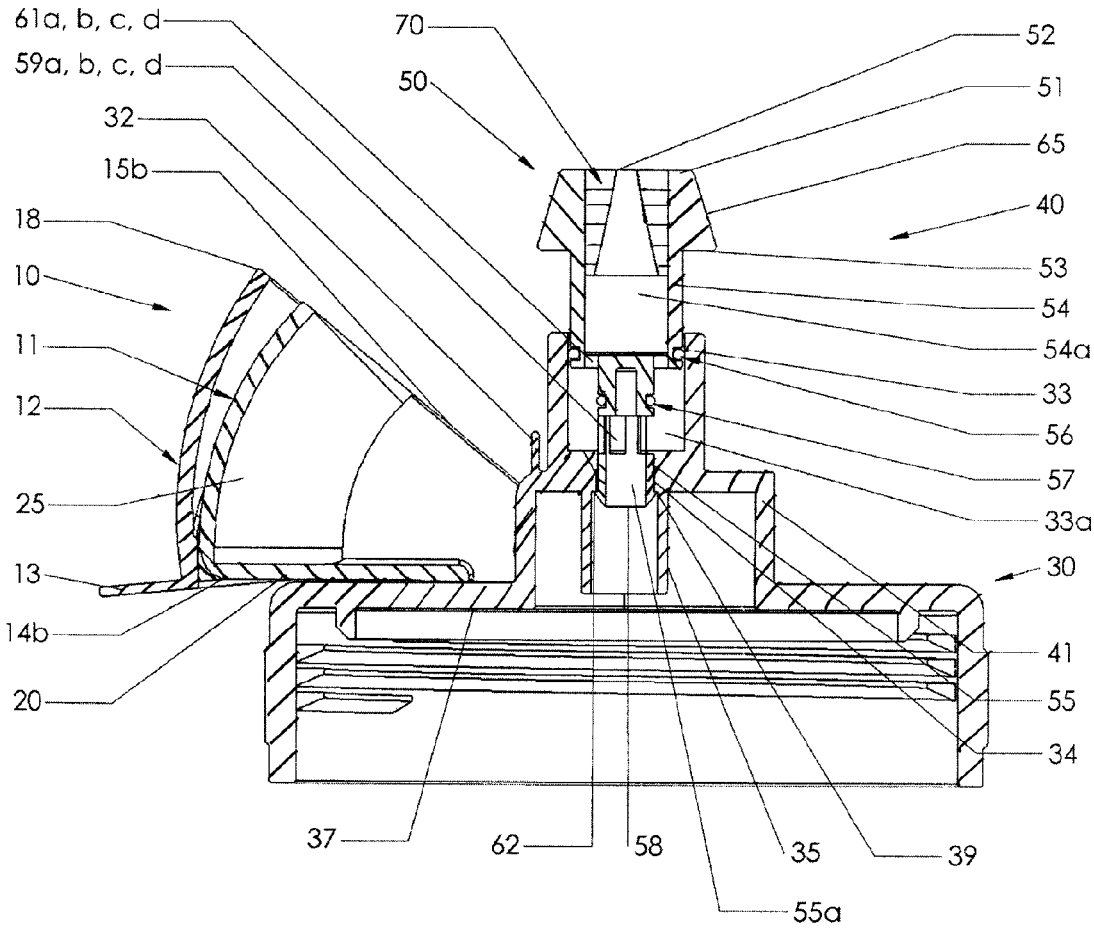
FIG. 4 is a cross sectional view of FIG. 2 showing both the two-fold protective cover and the spout are in an open position.

In a preferred embodiment and as shown in FIG. 2, the two-fold protective cover 10 is comprised of an upper protective cover 11 with hinge holes 23*a* and 23*b* and a lower protective cover 12 with hinge holes 21*a* and 21*b* which can be pivoted over pivot pins 31*a* and 31*b* of the raised central platform 41 on the top of the threaded cap 30. A tongue-shaped handle 13 is provided on the lower protective cover 12 for enabling a user to use a finger to move the two-fold protective cover 10 to an open position or to a close position as shown in FIG. 3 and FIG. 4, respectively. As shown in FIG. 3, both the two-fold protective cover 10 and the spout 50 are in an open position. A user can use a finger to close the two-fold protective cover 10 by moving the tongue-shaped handle 13 provided on the lower protective cover 12 upward as follows: first, the lower protective cover 12 is moved up until the front end 18 of the lower protective cover 12 touches the top surface 51 of the mouth piece 65 and presses the spout 50 downward continuously to a close position by the inner surface 25 of the upper protective cover 11 until the bottom 53 of the mouth piece 65 rests on the top of the upper section of the central tubular element 33. At the same time, the left stopper 14*a* and right stopper 14*b* of the lower protective cover 12 touch the left stopper 15*a* and right stopper 15*b* of the upper protective cover 11 respectively and moving up both the lower protective cover 12 and the upper protective cover 11 continuously to a close position. The back plate 20 of the upper protective cover 11 is stopped by the stopper plate 32 on the top of the central platform 41 of the threaded cap 30. In addition, the left recess 16*a* and right recess 16*b* of the lower protective cover 12 are moved into the left snap lock 36*a* and right snap lock 36*b* (see FIG. 2) of the threaded cap 30 respectively for ensuring both spout 50 and two-fold protective cover 10 are in a close position (as shown in FIG. 4) and the opening 101 of the vent check valve 100 on the hole 38 of the central platform 41 is also closed by a projection 49 extending from the upper protective cover 11 as shown in FIGS. 2 and 5.

Figure 5:
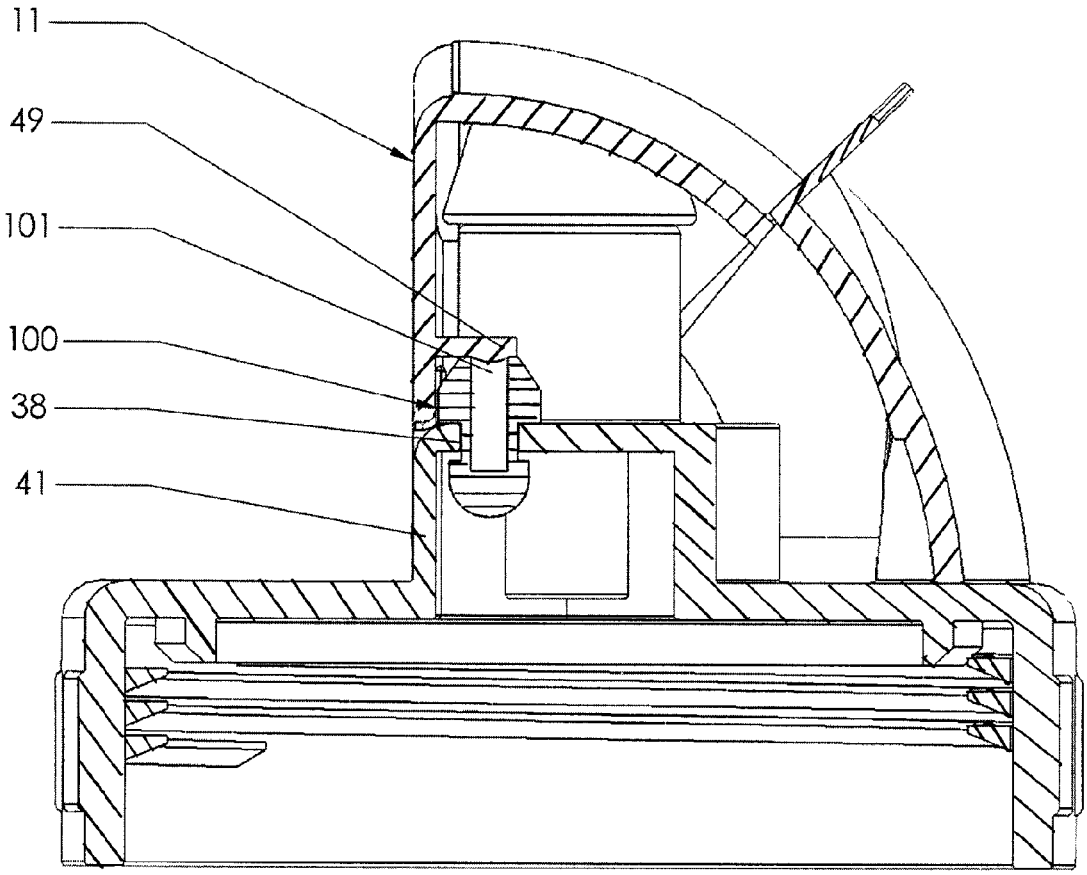
FIG. 5 is a cross sectional view of FIG. 2 showing the vent check valve is closed up by a projection of the upper protective cover in a close position.

FIG. 5 shows both the two-fold protective cover 10 and the spout 50 in a close position. A user can use a finger to open the two-fold protective cover by moving the handle 13 of the lower protective cover 12 downward as follows: first, the lower protective cover 12 is moved up continuously, then followed by the upper protective cover 11 until both the lower protective cover 12 and the upper protective cover 11 are in an open position as shown in FIG. 3, except the spout 50 remains in a close position.

As shown in FIG. 3, both the two-fold protective cover 10 and the spout 50 are in an open position. The spout 50 is prevented from coming out of the upper section of the central tubular element 33 of the threaded cap 30 due to the size of annular flange 62 of the spout 50 is bigger than top portion 39 of the lower section 55 of the spout 50.

The fluid flow path through the threaded cap 30 is now described here below. An opening hollow central tubular element defines the flow path. The central tubular element includes three sections, namely (i) the inside of the upper section 33 with a transverse dimension larger than that of (ii) the middle section 34, whereby the inside of the bottom portion of the upper section 33 is chambered to a transverse dimension which is the same as that of the middle section 34 and (iii) the inside of the lower section 35 having a transverse dimension larger than that of the middle section 34. This unique design ensures a smooth fluid flow path on the one hand, yet prevents any accidental fluid leaking on the other hand.

As indicated earlier, FIG. 3 shows a spout 50 having an outlet opening 52 and is inserted in the central tubular elements 33, 34 and 35 for sliding along an axis between open and close positions. Spout 50 is hollow and includes the upper section 54 and lower section 55 with a partition in between the upper section 54 and lower section 55.

Figure 6:
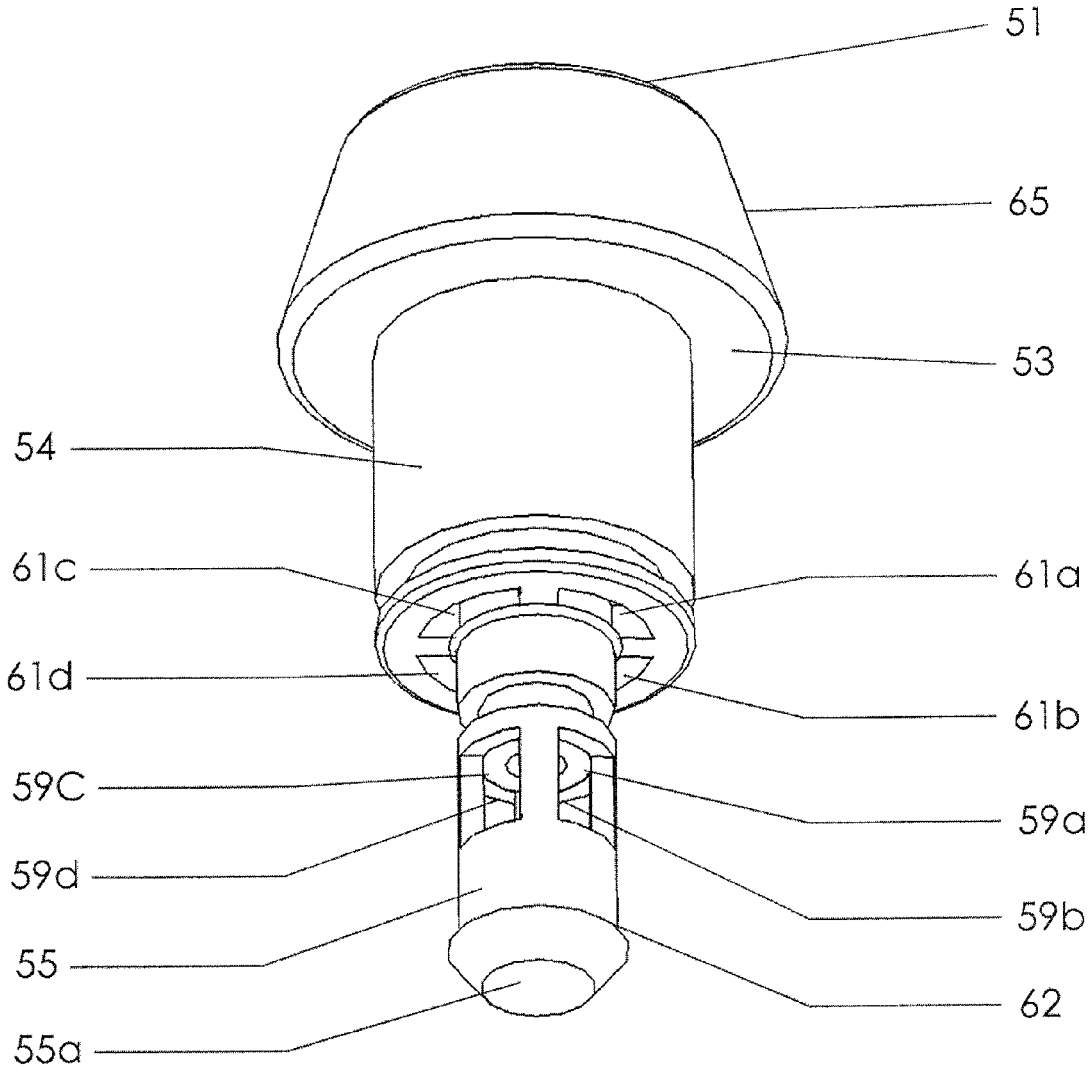
FIG. 6 is an elevation view of the spout.
Figure 7:
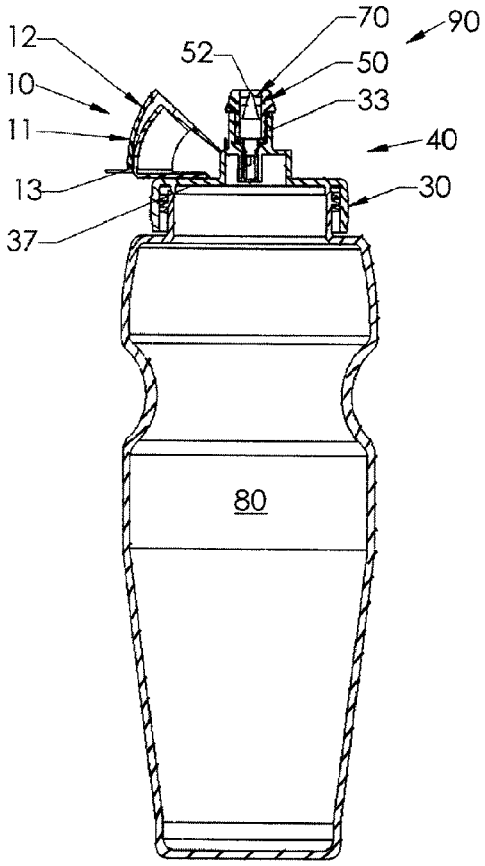
FIG. 7 is a cross sectional view of the bottle suitable for tip up and sucking the fluid from the container without water treatment unit.

The spout 50 also includes two sealing elements in the shape of O-rings. The first sealing element, O-ring 56 is disposed about an outer surface of the upper section 54 of the spout 50. The second sealing element, O-ring 57 is disposed about an outer surface of the lower section 55 of the spout 50. The O-ring 56 is always in continuous contact with the inner surface of the upper section of central tubular element 33 located on the top of the platform 41 on the threaded cap 30 resulting in fluid can only flow through the inside of the spout 50. The bottom of the upper section are provided with openings on the space in between the inner surface of the outer section and outer surface of the lower section 55 of the spout 50. The wall of the lower section of the spout 50 is also provided with openings below the second sealing element, O-ring 57, and the bottom of the lower section with an annular flange 62. When the bottle 90 is tipped up, fluid will flow into spout 50 through the lower inlet 58 of the spout 50, then into the chamber 55*a* of lower section 55 of the spout 50, then through a plurality of holes 59*a*, 59*b*, 59*c* and 59*d* located on the partition between the upper and lower section of the spout 50 into the chamber 33*a* of the upper section of central tubular element 33, then through the a plurality of holes 61*a*, 61*b*, 61*c* and 61*d* located on the wall of the lower section of the spout 50 into chamber 54*a* of the upper section 54 of the spout 50 and eventually exit the bottle 90 through the upper outlet opening 52 of the spout 50. FIG. 6 shows the detail location of the holes 59*a*, 59*b*, 59*c*, 59*d*, 61*a*, 61*b*, 61*c* and 61*d*.

Referring to FIG. 3, when the spout 50 is in an open position, the second sealing element, O-ring 57, is positioned inside the upper central tubular element 33 without any contact with the inner surface of the central tubular element for opening up the fluid path from the container. However, when both the two-fold protective cover 10 and the spout 50 are in a close position (as indicated in FIG. 4), with the bottle 90 tips up, the path of fluid flow is blocked by O-ring 57. In this close position, O-ring 57 is disposed on the outer surface of the lower section 55 of the spout 50 and O-ring 57 is only in contact with the inner surface of the middle section of the central tubular element 34 which located just level the surface of the platform 41 on the threaded cap 30 for closing up the fluid path from the container. There is no need of axial compression on the spout 50 to insure against leakage. As long as the center of O-ring 57 is within the inner surface of the middle section of the central tubular element 34, leak-proof is guaranteed.

In addition, a spout insert 70, which takes the shape of a tube, is housed and operatively connected to the upper section 54 of the spout 50. The inside transverse dimension of spout insert 70 at the top is smaller than that at the bottom. This unique design allows spout insert 70 to reduce the cross-section area of the upper outlet opening 52 of the spout 50. Due to surface tension of the fluid, fluid that remains inside the chamber 54*a* of the upper section 54 of the spout 50 after the spout 50 is in a close position will not be dripped out in any circumstances.

In order to hold the spout 50 in the close position, the design of the present invention provides the bottom of the top chamber portion of the upper section 54*a* of the spout 50 with a larger transverse dimension than that of the upper section of the central tubular element 33. Likewise, in order to hold the spout 50 in the open position, the design of the present invention provides the bottom of the middle section of the central tubular element 34 with a transverse dimension smaller than that of the annular flange 62 of the lower section of the spout 50.

Figure 8:
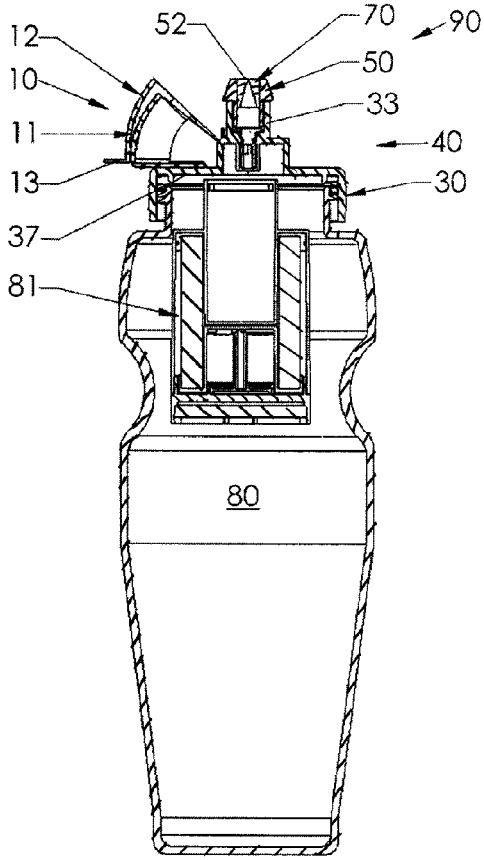
FIG. 8 is a cross sectional view of the bottle suitable for tip up and sucking the fluid from the container with water treatment unit.

Referring to FIG. 8, preferably, the threaded cap 30 has a raised platform 41 to ensure both the lower section 55 of the slidable spout 50 and the lower section of the central tubular element 35 are well above the bottom surface 37 of the threaded cap 30. Thus, an optional water treatment unit 81 can be inserted in between the threaded cap 30 and the opening of the container 80.

Figure 9:
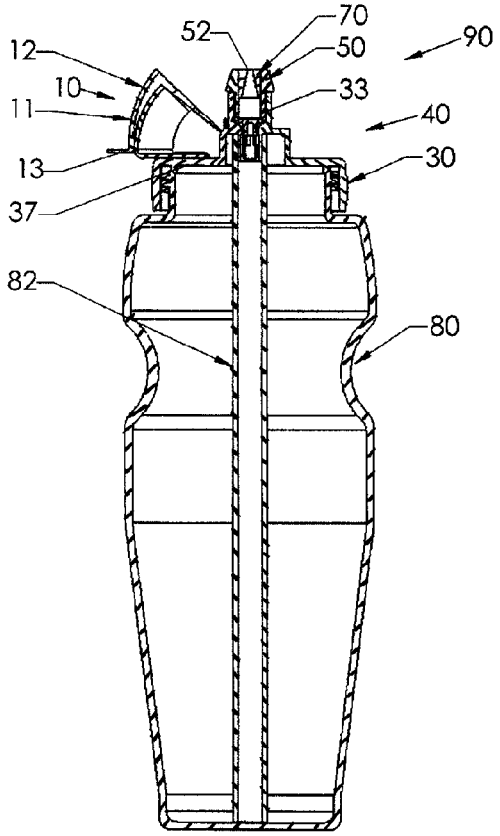
FIG. 9 is a cross sectional view of the bottle suitable for the purpose of sucking the fluid from the container with bottle in a vertical position without water treatment unit.

The bottle 90 can be used in either one of the two ways. Firstly, a user can tip up the bottle and suck the fluid from the container. Alternatively, with a flexible tube 82 connected to the lower central tubular element on the threaded cap to the bottom of the container, a user can suck the fluid from the container with the bottle in a substantially vertical position. Referring to FIG. 9, one end of a flexible tube 82 is connected to the lower section of the central tubular element 35 and the other end is touching the bottom of the container 80. The flexible tube 82 enables a user to suck the fluid from the container with bottle 90 in vertical position.

Figure 10:
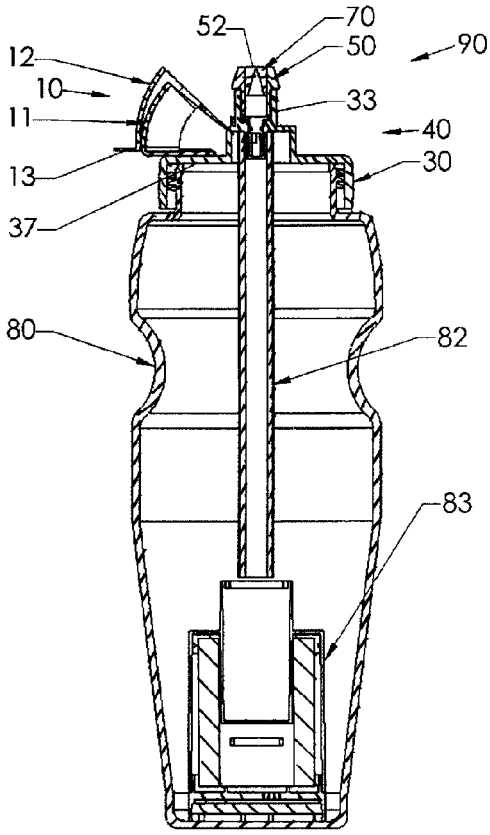
FIG. 10 is a cross sectional view of the bottle suitable for the purpose of sucking the fluid from the container with bottle in a vertical position with water treatment unit.

Optionally and as shown in FIG. 10, one end of flexible tube 82 is connected to the lower section of the central tubular element 35 and the other end is connected to a water treatment unit 83 sitting on the bottom of the container 80 to enable a user to suck the fluid from the container with bottle 90 in vertical position.

It will also be understood that the preferred embodiments of the present invention, which have been described, are merely illustrative of the principles of the present invention. Numerous modifications may be made by those skilled in the art without departing from the true spirit and scope of the invention.

What is claimed is:

1. A bottle comprising:

(a) a container;

(b) a closure device comprising, (i) a threaded cap for closing said container;

(ii) a hollow central tubular element defining a flow path through said cap, said central tubular element including upper, middle, and lower element sections, the inside of the upper element section having a transverse dimension larger than that of the middle element section, the inside of a bottom portion of said upper element section being chambered to a transverse dimension the same as that of said middle element section, and the inside of the lower element section having a transverse dimension larger than that of said middle element section; and (iii) a spout having an outlet opening and being inserted in said central tubular element for sliding along an axis between open and close positions, said spout being hollow including an upper spout section and lower spout section having a partition in between said upper spout section and said lower spout section, said spout also including first and second sealing elements, said first sealing element being disposed about an outer surface of said upper spout section and said second sealing element disposed about an outer surface of said lower spout section, a top chamber portion of said upper spout section having a transverse dimension bigger than that of a lower portion of said upper spout section, the bottom of said upper spout section having openings on a space in between an inner surface of said upper spout section and an outer surface of said lower spout section, a wall of said lower spout section also having openings below said second sealing element, and the bottom of said lower spout section having an annular flange.

2. The bottle of claim 1, wherein the bottom of said top chamber portion of said upper spout section of said spout has a larger transverse dimension than that of said upper element section of said central tubular element for holding said spout in said close position.

3. The bottle of claim 1, wherein the bottom of said middle element section of said central tubular element has a transverse dimension smaller than that of said annular flange of the lower spout section of said spout for holding said spout in said open position.

4. The bottle of claim 1, wherein said first sealing element is in continuous contact with the inner surface of said upper element section of said central tubular element.

5. The bottle of claim 1, wherein said second sealing element is only in contact with the inner surface of said middle element section of said central tubular element when said spout is in said close position.

6. The bottle of claim 1, wherein a tube is housed and operatively connected to said upper spout section of said spout, with the inside transverse dimension of said tube at the top of said tube being smaller than that of said tube at the bottom.

7. A bottle comprising:

(a) a container;

(b) a closure device comprising, (i) a threaded cap for closing said container, including two pivot pins located above the surface of said threaded cap on one side of the center of said threaded cap, at least one snap lock located on the surface of said threaded cap on the other side of the center of said threaded cap, and a hole for putting in a vent check valve;

(ii) a hollow central tubular element defining a flow path through said cap, said central tubular element including upper, middle, and lower element sections, the inside of the upper element section having a transverse dimension larger than that of the middle element section, the inside of a bottom portion of said upper element section being chambered to a transverse dimension the same as that of said middle element section, and the inside of the lower element section having a transverse dimension larger than that of said middle element section;

(iii) a spout having an outlet opening and being inserted in said central tubular element for sliding along an axis between open and close positions, said spout being hollow including an upper spout section and lower spout section with a partition in between said upper spout section and said lower spout section, said spout also including first and second sealing elements, said first sealing element being disposed about an outer surface of said upper spout section and said second sealing element being disposed about an outer surface of said lower spout section, a top chamber portion of said upper spout section having a transverse dimension bigger than that of a lower portion of said upper spout section, the bottom of said upper spout section having openings on a space in between an inner surface of said upper spout section and an outer surface of said lower spout section, a wall of said lower spout section also having openings below said second sealing element, and the bottom of said lower spout section having an annular flange; and (iv) a multi-fold protective cover wherein each fold is a curved sector having two hinged holes at two sides of a vertex end of said each fold, the first fold having a curved plate at an outer top surface, the last fold having a plate at the back, a projection being on the inner surface of said back plate of said last fold, and at least one recess being above a front arc of said first fold at an inner surface of said first fold.

8. The bottle of claim 7, wherein the bottom of said top chamber portion of said upper spout section of said spout has a larger transverse dimension than that of said upper element section of said central tubular element for holding said spout in said close position.

9. The bottle of claim 7, wherein the bottom of said middle element section of said central tubular element has a transverse dimension smaller than that of said annular flange of the lower spout section of said spout for holding said spout in said open position.

10. The bottle of claim 7, wherein said first sealing element is in continuous contact with the inner surface of said upper element section of said central tubular element.

11. The bottle of claim 7, wherein said second sealing element is only in contact with the inner surface of said middle element section of said central tubular element when said spout is in said close position.

12. The bottle of claim 7, wherein said multi-fold cover is in a close position for ensuring that the spout is also in the close position.

13. The bottle of claim 7 and wherein said multi-fold cover is in a close position for ensuring that the opening of said vent check valve is closed by said projection on said back plate of said last fold.

14. The bottle of claim 7, wherein a tube is housed and operatively connected to said upper spout section of said spout, with the inside transverse dimension of said tube at the top of the tube being smaller than that of said tube at the bottom.

15. The bottle of claim 7, wherein said multi-fold protective cover is a two-fold protective cover.

16. A bottle comprising:

(a) a container;

(b) a closure device comprising, (i) a threaded cap having a raised platform at the center of the cap for closing said container;

(ii) a hollow central tubular element at the top of said platform defining a flow path through said cap, said central tubular element including upper, middle, and lower element sections, the inside of the upper element section having a transverse dimension larger than that of the middle element section, the inside of a bottom portion of said upper element section being chambered to a transverse dimension the same as that of said middle element section, and the inside of the lower element section having a transverse dimension larger than that of said middle element section; and (iii) a spout having an outlet opening and being inserted in said central tubular element for sliding along an axis between open and close positions, said spout being hollow and including an upper spout section and a lower spout section with a partition in between said upper spout section and said lower spout section, said spout also including first and second sealing elements, said first sealing element being disposed about an outer surface of said upper spout section and said second sealing element disposed about an outer surface of said lower spout section, a top chamber portion of said upper spout section having a transverse dimension bigger than that of a lower portion of said upper spout section, the bottom of said upper spout section having openings on a space in between an inner surface of said upper spout section and an outer surface of said lower spout section, a wall of said lower spout section also having openings below said second sealing element, and the bottom of said lower spout section having an annular flange.

17. The bottle of claim 16, wherein the bottom of said top chamber portion of said upper spout section of said spout has a larger transverse dimension than that of said upper element section of said central tubular element for holding said spout in said close position.

18. The bottle of claim 16, wherein the bottom of said middle element section of said central tubular element has a transverse dimension smaller than that of said annular flange of the lower spout section of said spout for holding said spout in said open position.

19. The bottle of claim 16, wherein said first sealing element is in continuous contact with the inner surface of said upper element section of said central tubular element.

20. The bottle of claim 16, wherein said second sealing element is only in contact with the inner surface of said middle element section of said central tubular element when said spout is in said close position.

21. The bottle of claim 16, wherein both said lower element section of said central tubular element and said lower spout section of said spout are above the surface of said threaded cap.

22. The bottle of claim 16, wherein a tube is housed and operatively connected to said upper spout section of said spout, with the inside transverse dimension of said tube at the top of said tube being smaller than that of said tube at the bottom.

23. A bottle comprising:

(a) a container;

(b) a closure device comprising, (i) a threaded cap having a raised platform at the center of said threaded cap for closing said container, including two pivot pins located above the surface of said threaded cap on one side of the center of said threaded cap, at least one snap lock located on the surface of said threaded cap on the opposite side of said center of said threaded cap, and a hole for putting in a vent check valve;

(ii) a hollow central tubular element at the top of said platform defining a flow path through said cap, said central tubular element including upper, middle, and lower sections, the inside of the upper element section having a transverse dimension larger than that of the middle element section, the inside of a bottom portion of said upper element section being chambered to a transverse dimension the same as that of said middle element section, and the inside of the lower element section having a transverse dimension larger than that of said middle element section;

(iii) a spout having an outlet opening and being inserted in said central tubular element for sliding along an axis between open and close positions, said spout being hollow and including an upper spout section and a lower spout section with a partition in between said upper spout section and said lower spout section, said spout also including first and second sealing elements, said first sealing element being disposed about an outer surface of said upper spout section and said second sealing element being disposed about an outer surface of said lower spout section, a top chamber portion of said upper spout section having a transverse dimension bigger than that of a lower portion of said upper spout section, the bottom of said upper spout section having openings on a space in between an inner surface of said upper spout section and an outer surface of said lower spout section, a wall of said lower spout section also having openings below said second sealing element, and the bottom of said lower spout section having an annular flange; and (iv) a multi-fold protective cover wherein each fold is a curved sector having two hinged holes at two sides of a vertex end of said each fold, the first fold having a curved plate at an outer top surface, the last fold having a plate at the back, a projection being on the inner surface of said back plate of said last fold, and at least one recess being above a front arc of said first fold at an inner surface of said first fold.

24. The bottle of claim 23, wherein the bottom of said top chamber portion of said upper spout section of said spout has a larger transverse dimension than that of said upper element section of said central tubular element for holding said spout in said close position.

25. The bottle of claim 23, wherein the bottom of said middle element section of said central tubular element has a transverse dimension smaller than that of said annular flange of the lower spout section of said spout for holding said spout in said open position.

26. The bottle of claim 23, wherein said first sealing element is in continuous contact with the inner surface of said upper element section of said central tubular element.

27. The bottle of claim 23, wherein said second sealing element is only in contact with the inner surface of said middle element section of said central tubular element when said spout is in said close position.

28. The bottle of claim 23, wherein said multi-fold cover is in a close position for ensuring that said spout is also in the close position.

29. The bottle of claim 23 wherein said multi-fold cover is in a close position for ensuring that the opening of said vent check valve is closed by said projection on said back plate of said last fold.

30. The bottle of claim 23, wherein both said lower element section of said central tubular element and said lower spout section of said spout are above the surface of said threaded cap.

31. The bottle of claim 23, wherein a tube is housed and operatively connected to said upper spout section of said spout, with the inside transverse dimension of said tube at the top of the tube being smaller than that of said tube at the bottom.

32. The bottle of claim 23, wherein said multi-fold protective cover is a two-fold protective cover.

* * * * *